US008763507B2

(12) United States Patent
Ross

(10) Patent No.: US 8,763,507 B2
(45) Date of Patent: Jul. 1, 2014

(54) FLOW ISOLATION SUB FOR TUBING OPERATED DIFFERENTIAL PRESSURE FIRING HEAD

(75) Inventor: Colby W. Ross, Hockley, TX (US)

(73) Assignee: Baker Hughes Incorporated, Houston, TX (US)

( * ) Notice: Subject to any disclaimer, the term of this patent is extended or adjusted under 35 U.S.C. 154(b) by 74 days.

(21) Appl. No.: 13/278,707

(22) Filed: Oct. 21, 2011

(65) Prior Publication Data

US 2013/0098616 A1 Apr. 25, 2013

(51) Int. Cl.
*B64D 1/04* (2006.01)
*F41F 5/00* (2006.01)

(52) U.S. Cl.
USPC ..... 89/1.15; 175/4.55; 175/4.56; 175/4.57; 175/4.58; 175/4.59; 137/68.17; 137/119.08

(58) Field of Classification Search
USPC ..... 137/119.08, 68.17
See application file for complete search history.

(56) References Cited

U.S. PATENT DOCUMENTS

| | | | | | |
|---|---|---|---|---|---|
| 2,690,669 | A | * | 10/1954 | Giladett | 73/112.01 |
| 2,713,914 | A | * | 7/1955 | Kriegel | 166/320 |
| 3,626,967 | A | * | 12/1971 | McCarthy | 137/106 |
| 3,707,981 | A | * | 1/1973 | Sadler et al. | 137/115.16 |
| 4,051,767 | A | * | 10/1977 | Landsberg | 91/420 |
| 4,480,690 | A | * | 11/1984 | Vann | 166/250.07 |
| 4,534,414 | A | * | 8/1985 | Pringle | 166/317 |
| 4,544,034 | A | | 10/1985 | George | |
| 4,554,981 | A | | 11/1985 | Davies | |
| 4,606,409 | A | | 8/1986 | Peterson et al. | |
| 4,690,227 | A | | 9/1987 | George et al. | |
| 4,729,406 | A | * | 3/1988 | Frentzel | 137/624.14 |
| 4,880,056 | A | | 11/1989 | Nelson et al. | |
| 4,969,525 | A | | 11/1990 | George et al. | |
| 5,016,716 | A | | 5/1991 | Donovan et al. | |
| 5,018,580 | A | | 5/1991 | Skipper | |
| 5,191,933 | A | | 3/1993 | Edwards et al. | |
| 5,462,117 | A | | 10/1995 | Green et al. | |
| 5,472,010 | A | * | 12/1995 | Gonzalez | 137/119.08 |
| 5,603,384 | A | | 2/1997 | Bethel et al. | |
| 5,680,905 | A | | 10/1997 | Green et al. | |
| 6,102,126 | A | | 8/2000 | Huber et al. | |
| 6,116,343 | A | | 9/2000 | Van Petegem et al. | |
| 6,457,521 | B1 | | 10/2002 | Langseth et al. | |
| 6,491,098 | B1 | | 12/2002 | Dallas | |
| 7,325,616 | B2 | | 2/2008 | Lopez de Cardenas et al. | |
| 7,913,603 | B2 | | 3/2011 | LaGrange et al. | |
| 2010/0206633 | A1 | * | 8/2010 | Moore et al. | 175/4.56 |

OTHER PUBLICATIONS

International Search Report and Written Opinion (PCT/US2012/060945), dated Mar. 4, 2013.

* cited by examiner

*Primary Examiner* — Samir Abdosh
(74) *Attorney, Agent, or Firm* — Bracewell & Giuliani LLP

(57) ABSTRACT

An isolation sub for use in a perforating system that includes a pressure activated firing head. The isolation sub is set between the pressure source that is used to initiate the firing head. A pressure regulator in the sub is responsive to fluctuations in pressure difference between the pressure source and wellbore and isolates the firing head when the pressure difference is at or approaches a designated pressure difference that could initiate the firing head. The pressure regulator includes a spring loaded piston that seals the firing head from the source pressure before the pressure difference activates the firing head.

7 Claims, 4 Drawing Sheets

FLOW ISOLATION SUB FOR TUBING OPERATED DIFFERENTIAL PRESSURE FIRING HEAD

BACKGROUND

1. Field of Invention

The invention relates generally to a method and system for perforating a wellbore. More specifically, the present invention relates to a sub for regulating pressure for actuating a differential pressure firing head.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically lined with a string of casing and cement is generally pumped into the annular space between the wellbore wall and the casing. Reasons for cementing the casing against the wellbore wall includes retaining the casing in the wellbore and hydraulically isolating various earth formations penetrated by the wellbore. Sometimes an inner casing string is included that is circumscribed by the casing. Without the perforations oil/gas from the formation surrounding the wellbore cannot make its way to production tubing inserted into the wellbore within the casing.

Perforating systems typically include one or more perforating guns connected together in series to form a perforating gun string, which can sometimes surpass a thousand feet of perforating length. The gun strings are usually lowered into a wellbore on a wireline or tubing, where the individual perforating guns are generally coupled together by connector subs. Included with the perforating gun are shaped charges that typically include a housing, a liner, and a quantity of high explosive inserted between the liner and the housing. When the high explosive is detonated, the force of the detonation collapses the liner and ejects it from one end of the charge at very high velocity in a pattern called a jet that perforates the casing and the cement and creates a perforation that extends into the surrounding formation. Each shaped charge is typically attached to a detonation cord that runs axially within each of the guns. Firing heads are usually included with the perforating systems for initiating detonation of the detonation cord. Currently known firing heads may respond to command signals sent via a wireline, telemetry, or from a differential between firing head and wellbore pressure.

SUMMARY OF THE INVENTION

The present invention includes methods and devices for isolating pressure from a portion of a perforating system. In one example described herein is an isolation sub for use with a perforating system that includes a body having a passage formed axially therethrough and a lateral port connecting the passage and outer surface of the body. An inlet end of the body is adapted for connection to a pressure source and in fluid communication with an inlet to the passage and an exit end of the body is adapted for connection to a firing head and in fluid communication with an exit of the passage. A pressure regulator is included in the passage that is made up of a valve body axially moveable in the passage having an upper end in selective sealing engagement with a downward facing seat in the passage and a lower end in selective sealing engagement with an upward facing seat in the passage. Thus when fluid flows into the passage an amount of which exits the passage through the port in which pressure is dissipated to create a pressure differential between the passage and outer surface of the body, the lower end of the valve body moves into sealing engagement with the upward facing seat and defines a flow barrier in the passage between the inlet and exit ends of the body. A bypass line is optionally included that is axially formed through the body and having an end connected to the passage at a location between the inlet and the port and another end connected to the passage between the port and the upward facing seat. In an example embodiment, a sleeve is coaxially retained in the passage with a shear pin above the port and that is selectively moveable to adjacent the port for blocking flow between the passage and the port. Alternatively, when the sleeve is adjacent the port, fluid is bypassed to the exit of the passage for providing pressure to a firing head. Optionally, a spring is included for biasing the valve body against the downward facing seat. In an alternate embodiment, the downward facing seat is adjacent to the port. Optionally, the upward facing seat is part of a lower sleeve that threadingly couples with a bore provided on the lower end, wherein the lower seat has an axial passage, an annular groove on an upper portion that extends radially outward from an upper end of the axial passage and that is in fluid communication with the passage between the port and inlet end.

Also included herein is a method of using pressure to actuate a firing head disposed in a wellbore. In an example embodiment the method includes providing a flow of pressurized fluid through a conduit to the firing head, diverting the flow from the passage into the wellbore and blocking pressure communication of the flow to the firing head when a pressure difference between the passage and wellbore exceeds a designated value. The designated value may be substantially the same as a pressure difference applied across the firing head for activating the firing head. In an example embodiment, the method further includes blocking flow to the wellbore from the passage and increasing pressure to the firing head to activate the firing head. Optionally, pressure communication of the flow to the firing head can be unblocked when the pressure difference is less than the designated value.

An example embodiment of an isolation sub for use with a subterranean perforating system is included herein. In one example the isolation sub includes a body having an axial passage, a port extending radially outward from the axial passage to an outer surface of the body, an inlet end in pressure communication with the axial passage and in selective attachment to a pressure source, an exit end in pressure communication with the axial passage and selectively connected to a firing head, and a pressure regulation means in the passage. In this example the pressure regulation means limits a pressure differential between a portion of the firing head and ambient to the body to a designated amount. In an optional embodiment, the isolation sub further includes a bypass line that is in pressure communication with the inlet end and with the passage adjacent the pressure regulation means. The pressure regulation means can include a piston that is axially urged against a seat to form a pressure barrier between the passage and the firing head when pressure in a fluid flowing from the passage through the port is decreased by an amount that is substantially the same as the designated amount. In one alternate embodiment, the piston has an upstream end that is biased into sealing engagement with a downstream facing seat so that all fluid flowing into the passage is forced through the port.

BRIEF DESCRIPTION OF DRAWINGS

Some of the features and benefits of the present invention having been stated, others will become apparent as the description proceeds when taken in conjunction with the accompanying drawings, in which.

Figure 1A:
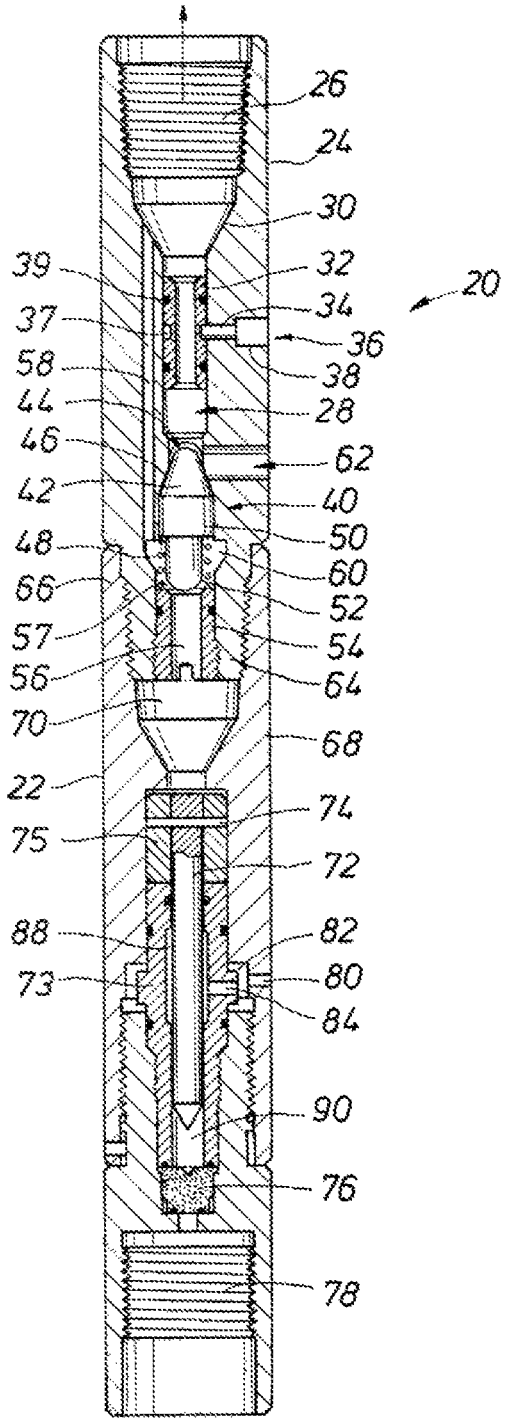
FIG. 1A is a side sectional view of an example embodiment of an isolation sub in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

Figure 1B:
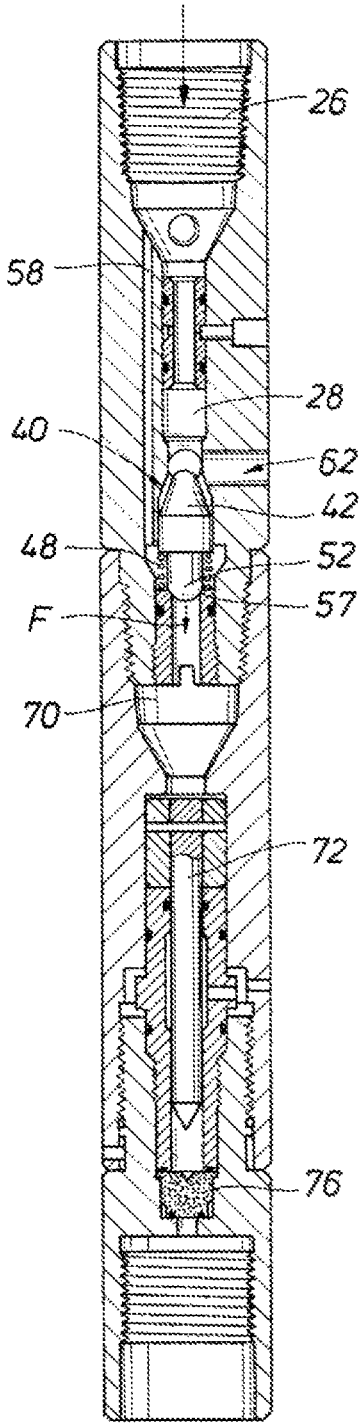
FIG. 1B is a side sectional view of the isolation sub of FIG. 1A isolating pressure communication to a firing head in accordance with the present invention.

FIGS. 1A and 1B illustrate in side sectional view an example embodiment of an isolation sub 20 used to selectively isolate pressure from a pressure activated firing head 22. In the example of FIG. 1A, the isolation sub 20 is shown having an elongate body 24 with a circular outer surface. Formed within an inlet end of the body 24 is a box fitting 26 whose outer periphery is generally conically shaped and threaded for connection to a lower end of a conduit (not shown) for delivering pressurized fluid to the sub 20. The fitting 26 is in pressure communication with a passage 28 that extends axially through the body 24. The passage 28 has an upper end 30, which is also conically shaped, and provides a transition from the lower radius passage 28 to the larger radius fitting 26.

An annular sleeve 32 is shown coaxially inserted within the passage 28, an upper edge of the sleeve 32 is located at about where the upper end 30 terminates. In the example of FIG. 1A, the sleeve 32 is held in place by a shear pin 34 that extends radially inward through the body 24 via a slot 36. An end of the pin 34 inserts into a recess 37 shown circumscribing the outer surface of the sleeve 32. A port 38 is shown outlined that also extends radially outward from the passage 28 into an outer surface of the body 24. O-ring seals 39 are shown around the sleeve 32 and disposed axially apart at opposite sides of the recess 37 for providing a pressure seal between the sleeve 32 and wall of the passage 28.

A check valve assembly 40 is further illustrated in the example of FIG. 1A and set within the passage 28 downstream of the sleeve 32. The check valve assembly 40 includes a valve body 42 that has a generally frusto-conically shaped upper end 44 that terminates in a rounded tip. An outer surface of the conically shaped portion of the end 44 is depicted in sealing engagement with an opposingly conically shaped seat 46 that is downward facing within the passage 28. On an end of the valve body 42 opposite its upper end 44 is a spring 48 that coaxially circumscribes a portion of the valve body 42 for biasing the valve body 42 into sealing engagement with the seat 46. A shoulder 50 is defined on the valve body 42 at a location where the valve body outer surface transitions radially inward. Past the shoulder 50 and away from the upper end 44 is a lower end 52 having a radius that is less than the mid-portion of the valve body 42 between the upper and lower ends 44, 52.

Further shown in the passage 28 is an annular sleeve 54 that is threadingly mounted within the passage 28. The sleeve 54 is set on a side of the valve body 42 opposite the sleeve 32 and also includes an annulus 56 whose radius is less than the radius of the lower end 52 of the valve body 42. An upward facing seat 57 is shown provided on the sleeve 56 and on a side facing the valve body 42. As will be described in more detail below, the contours of the lower end 52 and seat 57 are correspondingly shaped so that when engaged they form a pressure barrier. An axial bypass line 58 is shown axially formed through the sub body 24 and extending from the upper end 30 into a recess 60 in the sub body 24 that circumscribes the lower end 52 of the valve body 42. A port 62 is formed through the sub body 24 and extends radially outward from the passage 28 to the outer surface of the sub body 24 so that the passage 28 is in fluid communication with outside of the body 24. The port 62 is located such that axial movement of the valve body 42 does not block flow from the passage 28 and through the port 62.

A lower end of the body 24 is conically shaped and threaded to define a pin portion 64 for threaded engagement into a box portion 66 formed on an upper end of the body 68 of the firing head 22. The firing head 22 also includes an axial passage 70 whose upper end expands radially outward and shown in pressure communication with the annulus 56 in the sleeve 54. The passage 70 has a frusto-conically shaped upper end adjacent the box portion 66 and a substantially circular mid portion. The mid portion transitions radially outward to provide a housing for a piston assembly for the firing head 22. The piston assembly includes a firing pin 72 partially circumscribed by a sleeve 73. The firing pin 72 is held in place with a shear pin 74 whose opposing ends are set in a mounting block 75. A lower end of the firing pin 72 is shaped into a chiseled tip and shown spaced above a primer 76 set within the firing head 22. A threaded receptacle 78 is formed in the lower end of the firing head 22 and threaded for attachment to a perforating gun (not shown).

Still referring to FIG. 1A, a port 80 is shown formed through a sidewall of the body 68 of the firing head 22 and into fluid communication with an annular gallery chamber 82 that circumscribes a portion of the pin 72. Set radially inward from the gallery chamber 82 is an inner port 84 laterally through the sleeve 73. The inner port 84 provides pressure communication from the chamber 82 to an annular recess 88 that is formed in a space between the sleeve 73 and pin 72. The annular recess 88 is also in fluid communication with a lower chamber 90 that defines the open space between the lower tip end of the pin 72 and primer 76. Thus, the combination of the ports 80, 84, gallery chamber 82, and annular recess 88 allow open fluid communication with the outside of the firing head 22. Thus, when enough pressure differential exists between the passage 70 and lower chamber 90 to generate a force on the upper end of the pin 72 to shear the shear pin 74; the pin 72 is propelled downward and its pointed tip propelled into contact against the primer 76 for creating a detonation to initiate detonation of shaped charges and perforating guns (not shown).

Fluid flow exiting the port 62 may create a sufficient pressure differential between the passage 70 and chamber 90 to actuate the firing head 22. In one example a surge of flow through the passage 28 that then exits the port 62 can create a pressure differential between the passage and the space ambient to the firing head 22. Ultimately, the surge flow rate may be large enough so that the ensuing pressure differential activates the firing head 22. Referring now to FIG. 1B, the check valve assembly is responsive to pressure increases caused by increasing flow rate and closes to isolate the firing head 22 from a pressure source that can cause it to activate. The pressure differential between the passage 28 and passage 70 provides a resultant force F that downwardly urges the valve body 42 so that its lower end 52 is forced into sealing engagement with the seat 57. Engaging the valve body 42 with the seat 57 blocks supply pressure in the box fitting 26 and bypass 58 from the firing pin 72. Thus, as long as surging flow through passage 28 and exit port 62 produces a pressure differential that could propel the firing pin 72 against the primer 76; the force F will retain the valve body 42 in the sealing position. When the flow excursion has ceased thereby equalizing pressure between the passage 28 and passage 70, the spring 48 may then urge the valve body 42 into its position illustrated in FIG. 1A.

Figure 2A:
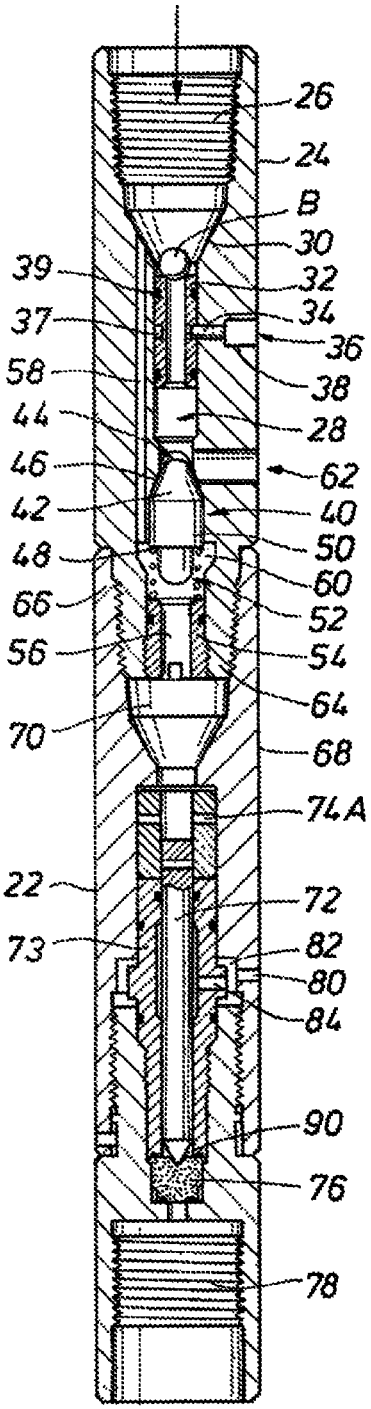
FIGS. 2A and 2B are side sectional views of the isolation sub of FIG. 1A allowing pressure communication to a firing head in accordance with the present invention.
Figure 2B:
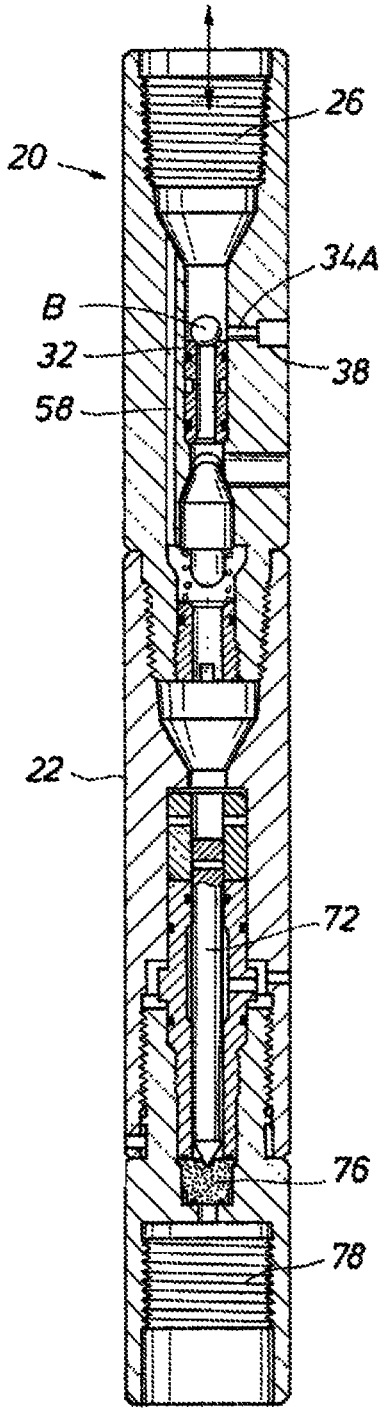

FIGS. 2A and 2B illustrate in side partial sectional view an example of how the firing head 22 may be actuated to initiate detonation of perforating guns. More specifically, shown in FIG. 2A, a spherical ball B has been dropped from surface and allowed to make its way with fluid in the supply conduit into the box fitting 26. The ball B is shown landed in an upper seat of the sleeve 32 and configured so that when seated a pressure differential is created when additional pressure is supplied onto the upper end of the ball B. The ball B therefore blocks flow through the passage 28 and through the port 62. Thus, additional flow of fluid combined with pressure pressurizes the bypass line 58 and passage 70. As the flow within the box fitting 26, bypass 58, and passage 70 is isolated from the outside of the firing head 22 by the inclusion of the ball B, pressure in the passage 70 will rise over that of the lower chamber 90 as additional fluid is forced into the box fitting 26. Ultimately, the pressure will exceed a designated pressure and the resulting force on the head of the pin 72 will fracture the shear pin 74A allowing the pin 72 to slide axially within the sleeve 73 and against the primer 76.

Optionally, after initiation of the firing head 22 pressure may continue to be supplied to the box fitting 26 until sufficient force is applied to the shear pin 34A and the sleeve 32, thereby causing that shear pin 34A to be severed and allow the sleeve 32 to slide axially within the passage 28, thereby providing fluid communication from within the firing head 22, bypass 58, and box fitting 26 to outside of the isolation sub 20. One advantage of moving the sleeve 32 as illustrated in FIG. 2B is that fluid pressures within the perforating system can be vented to the ambient pressures and not store excess pressures within sections of the perforating string.

Figure 3:
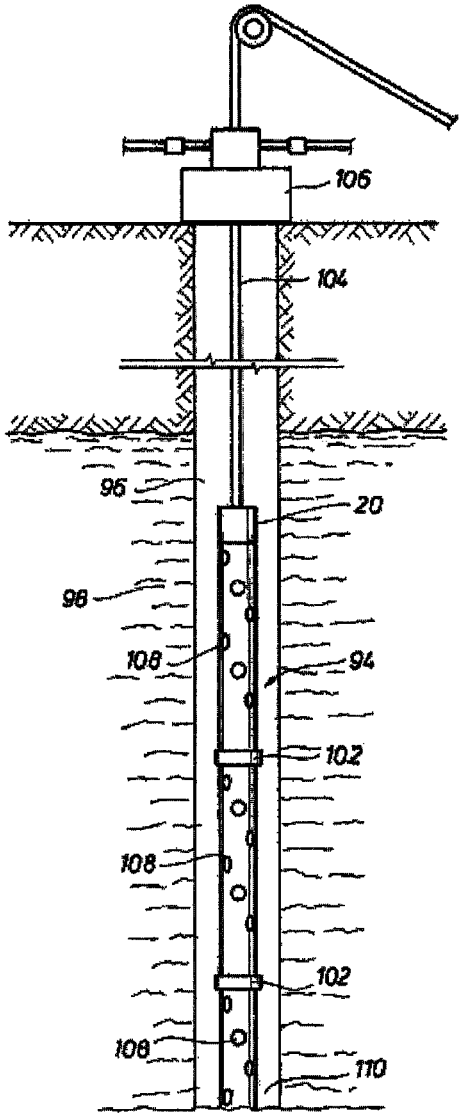
FIG. 3 is a side partial sectional view of an example embodiment of a perforating system having the isolation sub of FIG. 1 or 2 and disposed in a wellbore in accordance with the present invention.

FIG. 3 provides a side partial sectional view of an example of a perforating system 94 deployed within a wellbore 96 that is shown intersecting formation 98. In the example of FIG. 3, the perforating system 94 includes perforating guns 100 connected end to end by connectors 102. Once assembled in a string, the perforating system 94 can be deployed within the wellbore 96 on tubing 104 shown threaded through a wellhead assembly 106. Each of the perforating guns 100 of the example of FIG. 3 include shaped charges 108 that detonate in response to activating the firing head as described above. When disposed in the wellbore 96 an annulus 110 is defined in the annular space between the string 94 and inner surface of the walls of the wellbore 96. In an example, it is the pressure in the annulus 110 that defines the pressure outside of the isolation sub 20 and firing head 22 as described above.

Figure 4A:
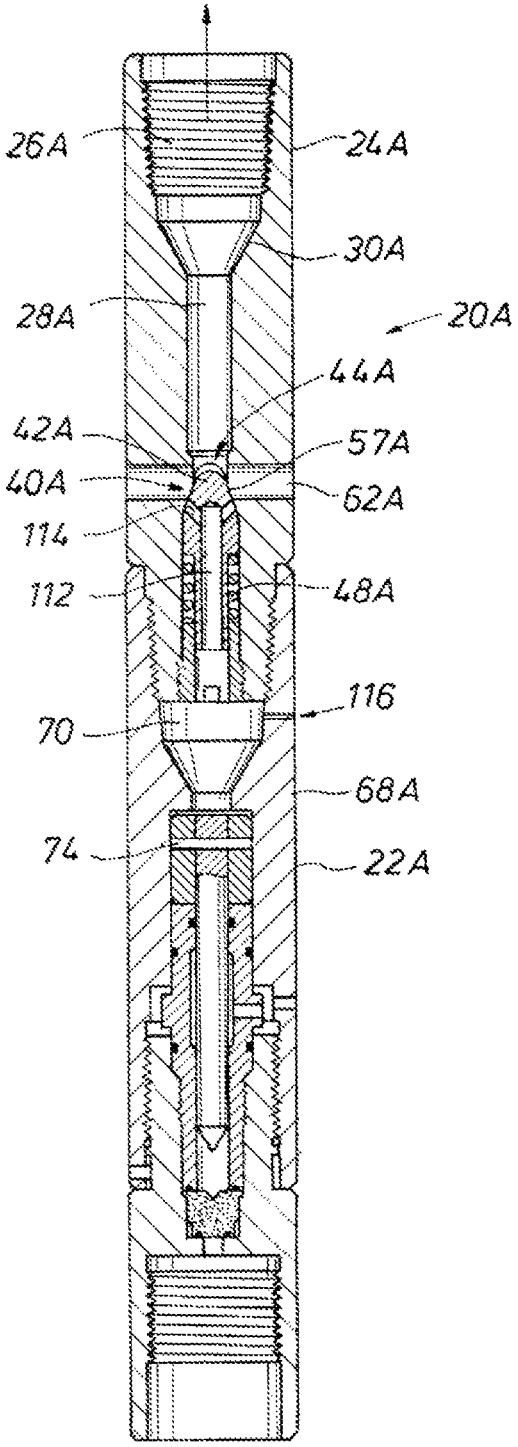
FIGS. 4A and 4B are side sectional views of an alternate example embodiment of an isolation sub in accordance with the present invention.
Figure 4B:
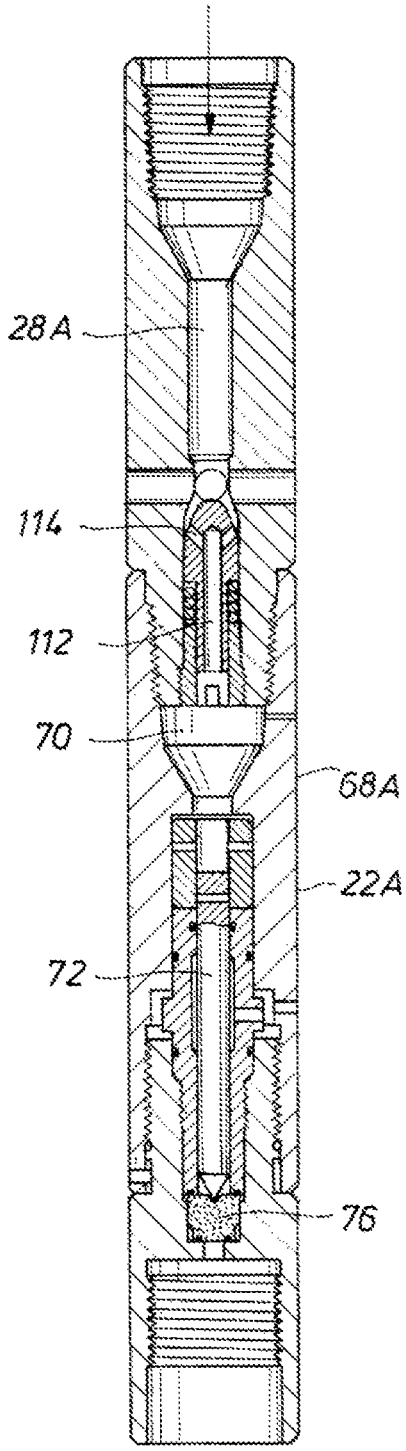

FIGS. 4A and 4B illustrate in side sectional view one alternate embodiment of an isolation sub 20A coupled with a firing head 22A. In the example of FIG. 4A a check valve assembly 40A is made up of a valve body 42A, that like the valve body 42 has an upper end 44A with conically shaped sides for sealing engagement with a downward facing seat in the body 24A of the isolation sub 20A. The body 24A of FIG. 4A includes multiple ports 62A that extend radially outward through the body 24A and proximate to the upper end 44A of the valve body 40A. Moreover, the valve body 40A has a bore 112 formed axially within the body and obliquely provided ports 114 that extend from the conically shaped portion of the upper end 44A into communication with the axial bore 112. As illustrated in FIG. 4B, the valve assembly 40A operates strictly on differential pressures between the passage 28A and passage 70 in the firing head 22A. A spring 48A is included for biasing the piston body 42A against the downward facing seat 57A. With sufficient pressure, as illustrated in FIG. 4B, flow from the passage 28A downwardly urges the piston body 42A and away from the seat 57A so that fluid can enter into the ports 114, into the bore 112 and force the pin 72 against the primer 76. An equalization port 116 is shown extending through the body 68A of the firing head 22A for providing a conduit between the passage 70 and ambient to the firing head 22A. Strategically sizing the equalization port 116 in relation to the cross sectional area of the passage 28A and volume of the passage 70 allows sufficient pressurization to occur in the passage 70 to fracture the shear pin 74 although some amount of fluid may escape the passage 70 through the port 116. Over time pressure from the passage 70 can vent through the port 116.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. An isolation sub for use with a perforating system comprising:

a body having a passage formed axially therethrough and a lateral port connecting the passage and outer surface of the body;

an inlet end of the body adapted for connection to a pressure source and in fluid communication with an inlet to the passage;

an exit end of the body adapted for connection to a firing head and in fluid communication with an exit of the passage; and a pressure regulator in the passage comprising a valve body axially moveable in the passage having an upper end in selective sealing engagement with a downward facing seat in the passage and a lower end in selective sealing engagement with an upward facing seat in the passage, so that when fluid flows into the passage an amount of which exits the passage through the port in which pressure is dissipated to create a pressure differential between the passage and outer surface of the body, the lower end of the valve body moves into sealing engagement with the upward facing seat and defines a flow barrier in the passage between the inlet and exit ends of the body.

2. The isolation sub of claim 1 further comprising, a bypass line axially formed through the body and having an end connected to the passage at a location between the inlet and the port and another end connected to the passage between the port and the upward facing seat.

3. The isolation sub of claim 1 further comprising, a sleeve coaxially retained in the passage with a shear pin above the port and that is selectively moveable to adjacent the port for blocking flow between the passage and the port.

4. The isolation sub of claim 3, wherein when the sleeve is adjacent the port, fluid is bypassed to the exit of the passage for providing pressure to a firing head.

5. The isolation sub of claim 1 further comprising, a spring for biasing the valve body against the downward facing seat.

6. The isolation sub of claim 1, wherein the downward facing seat is adjacent to the port.

7. The isolation sub of claim 1 wherein the upward facing seat is part of a lower sleeve that threadingly couples with a bore provided on the lower end, wherein the lower seat comprises an axial passage, an annular groove on an upper portion that extends radially outward from an upper end of the axial passage and that is in fluid communication with the passage between the port and inlet end.

* * * * *